US008621797B2

(12) United States Patent
Kim et al.

(10) Patent No.: US 8,621,797 B2
(45) Date of Patent: Jan. 7, 2014

(54) STEEL STRUCTURE INCLUDING PRE-STRESSING BRACKETS FOR IMPROVING LOAD-CARRYING CAPACITY AND SERVICEABILITY

(75) Inventors: Sang Hyo Kim, Seoul (KR); Jin Hee Ahn, Seoul (KR); Jung Ho Yoo, Seoul (KR); Seung Soo Han, Seoul (KR); Chang Keon Cho, Seoul (KR); Kyu Tae Choi, Seoul (KR)

(73) Assignees: Yooho Development & Construction Co. Ltd., Seoul (KR); Industry-Academic Cooperation Foundation, Yonsei University, Seoul (KR)

( * ) Notice: Subject to any disclaimer, the term of this patent is extended or adjusted under 35 U.S.C. 154(b) by 0 days.

(21) Appl. No.: 13/807,823

(22) PCT Filed: May 4, 2011

(86) PCT No.: PCT/KR2011/003358
§ 371 (c)(1),
(2), (4) Date: Dec. 31, 2012

(87) PCT Pub. No.: WO2012/002642
PCT Pub. Date: Jan. 5, 2012

(65) Prior Publication Data

US 2013/0097947 A1 Apr. 25, 2013

(30) Foreign Application Priority Data

Jul. 2, 2010 (KR) ..... 10-2010-0063988

(51) Int. Cl.
*E04C 3/10* (2006.01)

(52) U.S. Cl.
USPC ..... 52/223.8; 52/223.9

(58) Field of Classification Search
USPC ..... 52/223.8, 223.9, 223.12, 223.14, 690, 52/696, 837–839, 849; 14/74.5; 29/897.35
See application file for complete search history.

(56) References Cited

U.S. PATENT DOCUMENTS 1,634,127 A * 6/1927 Norman ..... 52/690
1,715,694 A * 6/1929 Coddington ..... 29/897.35

(Continued)

FOREIGN PATENT DOCUMENTS

JP 6-81312 * 3/1994
JP 6146405 5/1994

(Continued)

OTHER PUBLICATIONS

KR 2011131025A, Derwent-ACC-No. 2011-Q58236, Derwent-Week: 201282, (C) 2013.*

(Continued)

*Primary Examiner* — Robert Canfield
(74) *Attorney, Agent, or Firm* — IPLA P.A.; James E. Bame

(57) ABSTRACT

A steel structure including pre-stressing brackets for improving load-carrying capacity and serviceability comprises: a steel girder; a plurality of connecting brackets connected to the bottom surface of the steel girder spaced and apart from one; and a cover plate connected to the bottom surfaces of the connecting brackets. Since the cover plate is installed regardless of the connecting portion of the steel girder, pre-stressing section can be consecutively formed therefore pre-stress effect is improved. Moreover, since the connecting brackets space the cover plate a constant distance from the steel girder, the moment of inertia is increased so the span of a bridge might be increased.

4 Claims, 8 Drawing Sheets

(56) References Cited

U.S. PATENT DOCUMENTS

| | | | | | |
|---|---|---|---|---|---|
| 1,906,683 | A * | 5/1933 | Weiskopf et al. | 52/838 |
| 1,954,357 | A * | 4/1934 | Leake | 52/838 |
| 1,970,966 | A * | 8/1934 | Leake | 29/897.1 |
| 3,140,764 | A * | 7/1964 | Cheskin | 52/223.12 |
| 3,385,015 | A * | 5/1968 | Hadley | 52/223.8 |
| 4,006,523 | A * | 2/1977 | Mauquoy | 29/452 |
| 4,709,456 | A * | 12/1987 | Iyer | 29/897.35 |
| 5,313,749 | A * | 5/1994 | Conner | 52/223.12 |
| 5,671,572 | A * | 9/1997 | Siller-Franco | 52/223.8 |
| 6,389,766 | B1 * | 5/2002 | Jackson | 52/291 |
| 7,305,802 | B1 * | 12/2007 | Plavidal | 52/291 |
| 2012/0000153 | A1 * | 1/2012 | Kim | 52/223.13 |

FOREIGN PATENT DOCUMENTS

| | | |
|---|---|---|
| KR | 1019990073577 | 10/1999 |
| KR | 100882341 | 1/2009 |

OTHER PUBLICATIONS

KR 2000307716, Derwent-ACC-No. 2004-105298, Derwent-Week 20044, (C) 2013.*

* cited by examiner

STEEL STRUCTURE INCLUDING PRE-STRESSING BRACKETS FOR IMPROVING LOAD-CARRYING CAPACITY AND SERVICEABILITY

BACKGROUND OF THE INVENTION

The present invention relates to a steel structure including pre-stressing brackets for improving load-carrying capacity and serviceability thereof, and more particularly, to a steel structure including pre-stressing brackets for improving load-bearing capacity and use performance thereof wherein the connecting brackets are spaced apart from each other between a steel girder and a cover plate to prevent the installation of the cover plate from being limited by the connection portions of the neighboring steel girders, thereby allowing prestressing ranges to be continuously introduced to increase the prestressing effects, and the steel girder and the cover plate are spaced apart from each other by means of the formation of the connecting brackets, thereby increasing moment of inertia of section and optimizing section efficiency to provide a bridge for long span.

Generally, a steel girder is formed of an H-beam or I-beam and is adapted to be connected to piers or abutments of a bridge to constitute the upper structure of the bridge. In this case, the steel girder is made to a standard given size, that is, to a size of roughly 13 m to 15 m for the easiness of the manufacturing, carrying, and installing work thereof.

So as to allow the steel girders made to a given standard size to be used for long span, they are connected to each other, and thus, a connection portion should be formed on the end portions of the neighboring steel girders.

In this case, a steel plate is provided on the web and flanges formed on the end portion of each steel girder to allow the steel girders to be coupled to each other, and to do this, the steel plate and the web and flanges have the corresponding coupling holes to each other.

Thus, high tension bolts are inserted into their coupling holes and are fastened with nuts, thereby coupling the web and the steel plate and also coupling the flanges and the steel plate.

Accordingly, a thermal prestressing cover plate is covered fixedly on the connection portion of the steel girders used for long span, especially on the underside surface of the flange of each steel girder.

Because of the connection portion where the high tension bolts are fastened to connect the flange and the steel plate, at this time, it is hard to continuously cover the cover plates onto the steel girders.

The connection portion between the neighboring steel girders restricts and limits the continuous installation of the cover plates to cause the prestressing range caused by the cover plate to be limited to a size of 13 m to 15 m, so that the prestressing ranges are intermittently introduced to reduce the prestressing effects generated from the cover plate.

Furthermore, if the cover plate is connected directly to the steel girder in the conventional practice, the stiffness of the section caused by the moment of inertia of section is limited to the height of the steel girder, which causes the load-bearing capacity to be undesirably lowered, thereby making it impossible to be applicable to the bridge for long span.

DISCLOSURE

Summary of the Invention

Accordingly, the present invention has been made in view of the above-mentioned problems occurring in the prior art, and it is an object of the present invention to provide a prestressed steel structure for improving load-bearing capacity and use performance thereof wherein connecting brackets are spaced apart from each other between a steel girder and a cover plate to prevent the installation of the cover plate from being restricted by the connection portion between the neighboring steel girders, thereby allowing prestressing ranges to be continuously introduced to increase the prestressing effects.

It is another object of the present invention to provide a prestressed steel structure for improving load-bearing capacity and use performance thereof wherein a steel girder and a cover plate are spaced apart from each other by means of the formation of connecting brackets, thereby increasing moment of inertia of section and optimizing section efficiency to provide a bridge for long span.

It is still another object of the present invention to provide a prestressed steel structure for improving load-bearing capacity and use performance thereof wherein connecting brackets are gradually increased in heights from both end portions of a cover plate toward the center portion thereof, thereby strengthening the stiffness of the section at the center portion of the cover plate to optimize the prestressing effects, thus offsetting the stress generated by the dead load (fixed load) of the steel structure, and further increasing the section of the structure by the cover plate to provide economical effects.

To accomplish the above objects, according to the present invention, there is provided a prestressed steel structure for improving load-bearing capacity and use performance thereof, the prestressed steel structure including: a steel girder; connecting brackets spaced apart from each other in such a manner as to be connected to the underside surface of the steel girder; and a cover plate connected to the underside surfaces of the connecting brackets.

According to the present invention, desirably, the heights of the connecting brackets are gradually increased from both end portions of the cover plate toward the center portion thereof.

According to the present invention, desirably, each connecting bracket includes: an upper plate connected to the underside surface of the steel girder; a lower plate connected to the cover plate; side plates connected to both sides of the upper plate and the lower plate; and a reinforcement plate connected to each inner surface of the upper plate, the lower plate and the side plates in such a manner as to be located in a direction parallel to the longitudinal direction of the steel girder.

According to the present invention, desirably, the steel girder further includes reinforcement members connected to portions where the connecting brackets are located.

Advantageous Effects

According to the present invention, there is provided the prestressed steel structure for improving load-bearing capacity and use performance thereof wherein the connecting brackets are spaced apart from each other between the steel girder and the cover plate to prevent the installation of the cover plate from being restricted by the connection portion between the neighboring steel girders, thereby allowing prestressing ranges to be continuously introduced to increase the prestressing effects.

Further, the steel girder and the cover plate are spaced apart from each other by means of the formation of the connecting brackets, thereby increasing moment of inertia of section and optimizing the efficiency of the section to provide a bridge for long span.

Furthermore, the connecting brackets are gradually increased in heights from both end portions of the cover plate toward the center portion thereof, thereby strengthening the stiffness of the section at the center portion of the cover plate to optimize the prestressing effects, thus offsetting the stress generated by the dead load (fixed load) of the steel structure, and further increasing the section of the structure by the cover plate to provide economical effects.

DETAILED DESCRIPTION OF THE INVENTION

Figure 1A:
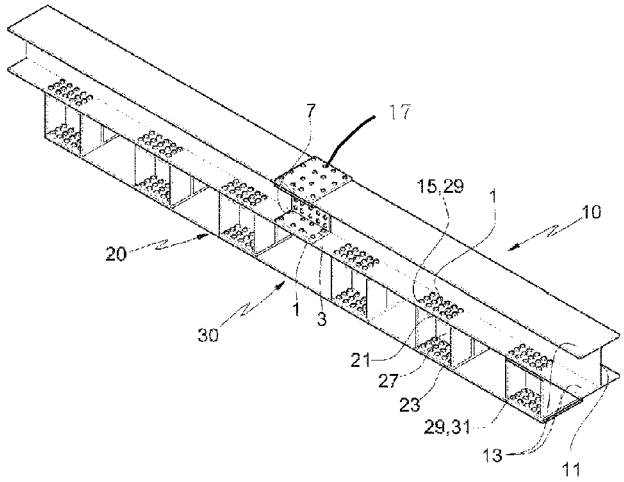
FIGS. 1*a* and 1*b* are perspective and front views showing a steel structure including pre-stressing brackets according to the present invention.
Figure 1B:
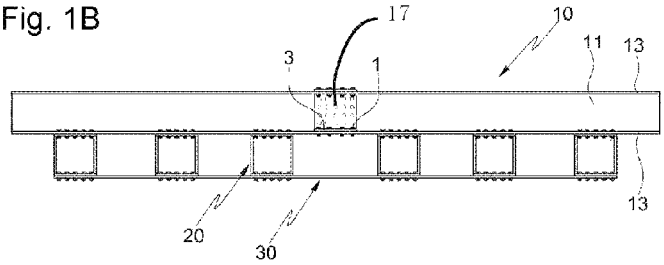
Figure 2A:
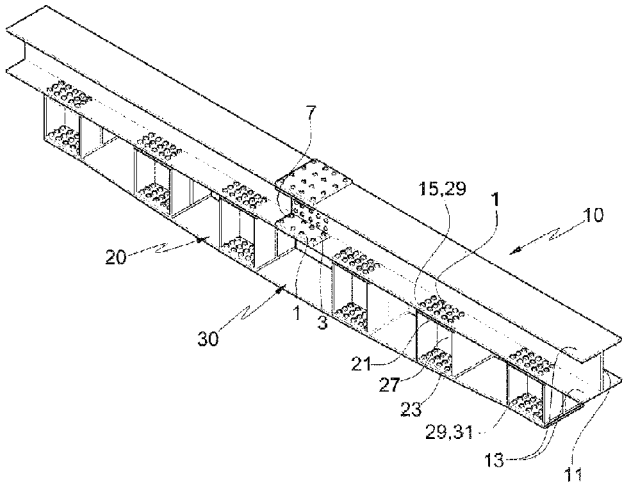
FIGS. 2*a* and 2*b* are perspective and front views showing a steel structure including pre-stressing brackets according to the present invention, wherein the prestressed connecting brackets have different heights.
Figure 2B:
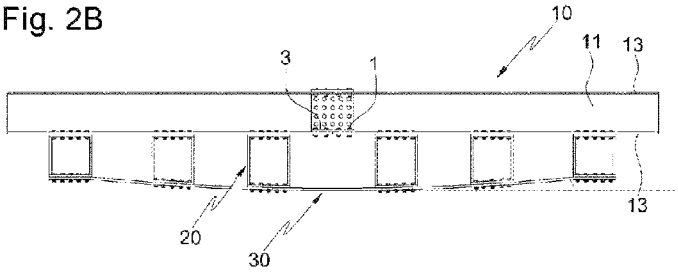
Figure 3A:
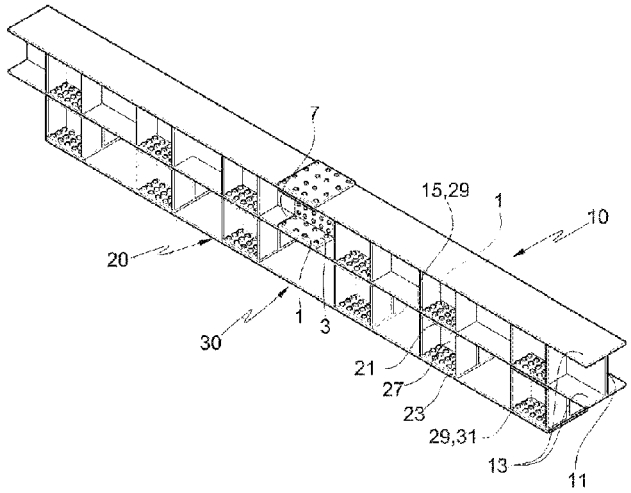
FIGS. 3*a* to 4*b* are perspective and front views showing variations of the steel structure including pre-stressing brackets according to the present invention.
Figure 3B:
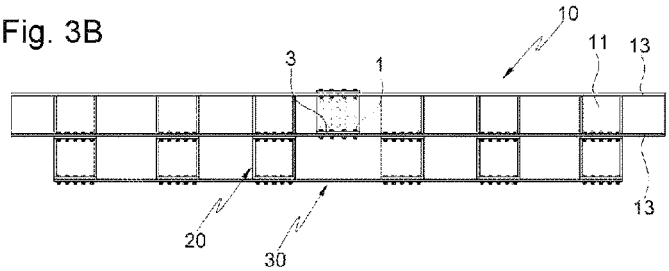
Figure 4A:
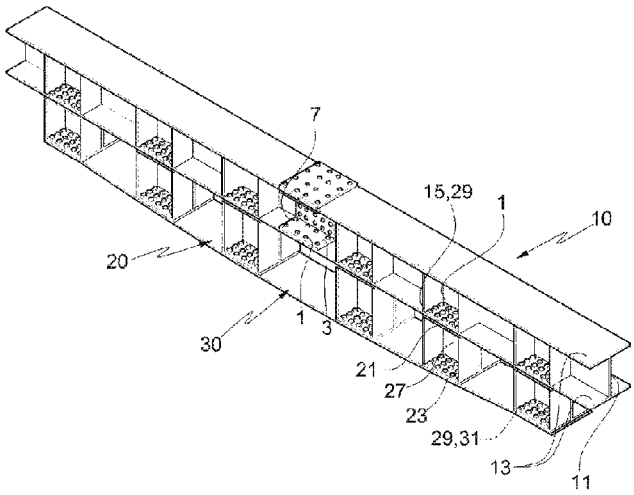
Figure 4B:
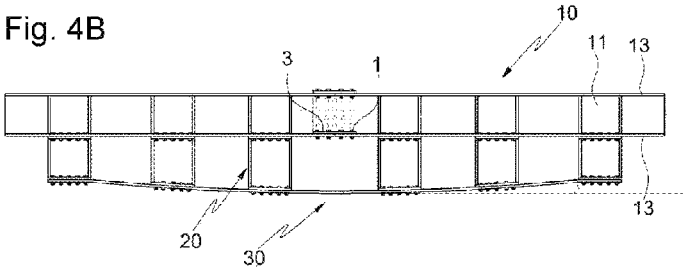

Hereinafter, an explanation on A steel structure including pre-stressing brackets for improving load-carrying capacity and serviceability according to the present invention will be given with reference to the attached drawings.

According to the present invention, as shown in FIGS. 1*a* to 5*b*, a steel structure including pre-stressing brackets for improving load-carrying capacity and serviceability thereof, includes: a steel girder 10; a plurality of connecting brackets 20 connected to the bottom surface of the steel girder 10 and spaced apart from one another; and a cover plate 30 connected to the bottom surfaces of the connecting brackets 20.

In the steel structure including pre-stressing brackets for improving load-carrying capacity and serviceability thereof according to the present invention, the steel girder 10 is connected to piers or abutments of a bridge to form the upper structure of the bridge, and generally, H-beam or I-beam, which is used as the steel girder 10, is made to a standard given size, that is roughly 13 m to 15 m for the convenience of the manufacturing, carrying, and installing work thereof.

To make a long span bride with those standard sized girder, the steel girder 10 should be connected to other steel girders 10, and thus, each end region of steel girder 10 has a connecting portion.

In this case a steel plate 3 is applied to webs 11 and flanges 13 of the end portions of the steel girders 10 and a plurality of coupling holes 17 are formed correspondingly on the webs 11 and flanges 13 and the steel plate 3.

A high tension bolt 1 is inserted into each coupling hole 17 and is fastened to a nut, thereby coupling the webs 11 and the steel plate 3, the flanges 13 and the steel plate 3.

It is hard to continuously locate the thermal pre-stressing cover plates 30 under the bottom surface of the steel girders 10 due to the connecting portions where the high tension bolts 1 are fastened to connect the flanges 13 and the steel plate 3.

The connecting portion between the neighboring steel girders 10 restricts the installation position of the cover plate 30 and causes the prestressing ranges to be limited to a size of 13 m to 15 m, so that the pre-stressing ranges couldn't be continuous therefore the pre-stressing effects is reduced.

Hereinafter, to solve those problems, an explanation of the connecting brackets 20 which is capable of continuous pre-stressing ranges without limit and improve the stiffness of cross section of the steel structure will be given in more detail.

In the steel structure including pre-stressing brackets for improving load-carrying capacity and serviceability thereof according to the present invention, as shown in FIGS. 1*a* to 3*b*, the connecting brackets 20 are connected to the underside surface of the steel girder 10 and spaced apart from one another, while allowing the steel girder 10 and the cover plate 30 to be spaced apart from each other.

Each connecting bracket 20 of the present invention includes an upper plate 21 connected to the bottom surface of the steel girder 10 along the longitudinal direction of the steel girder 10, a lower plate 23 connected to the cover plate 30, side plates 25 connected to both sides of the upper plate and the lower plate 23, and a reinforcement plate 27 connected to each inner surface of the upper plate 21, the lower plate 23 and the side plates 25, parallel to the longitudinal direction of the steel girder 10.

That is, the connecting bracket 20 of the present invention has a shape of a block or box, and has a plurality of fastening holes 29 formed on the upper plate 21 and the lower plate 23.

Further, a plurality of fastening holes 15 and 31 is formed on the corresponding positions of the flange 13 and the cover plate 30 to the fastening holes 29 of the upper plate 21 and the lower plate 23.

Accordingly, high tension bolts 1 are inserted into the fastening holes 29 of the upper plate 21 and into the fastening holes 15 of the flange 13 and are then fastened with nuts, thereby coupling the upper plate 21 of the connecting bracket 20 to the flange 13 of the steel girder 10.

Then, the high tension bolts 1 are inserted into the fastening holes 29 of the lower plate 23 and into the fastening holes 31 of the cover plate 30 and are then fastened with nuts, thereby coupling the lower plate 23 of the connecting bracket 20 to the cover plate 30.

In this case, the upper plate 21 of the connecting bracket 20 is coupled to the bottom surface of the steel girder 10 in the longitudinal direction of the steel girder 10, and then, the cover plate 30 is coupled to the lower plate 23 of the connecting bracket 20.

Alternatively, in the state where the cover plate 30 is coupled to the lower plate 23 of the connecting bracket 20, the upper plate 21 of the connecting bracket 20 to which the cover plate 30 has been coupled is coupled to the bottom surface of the steel girder 10.

The order of the installation work for the steel girder 10, the connecting brackets 20, and the cover plate 30 is just determined in consideration of the convenience and rapidness of the installation work.

Furthermore, as both side walls of the connecting bracket 20, the side plates 25 make the connecting brackets 20 to have a given height.

At this time, the heights of the side plates 25 should be sufficient to increase the moment of inertia of section of the steel structure, thereby strengthening the stiffness of cross section of the steel structure and enhancing the load-carrying capacity thereof.

Moreover, the reinforcement plate 27 of the connecting bracket 20 is provided inside of the connecting bracket 20 and is located parallel to the longitudinal direction of the steel girder 10, thereby strengthening the stiffness of the connecting bracket 20 and improving the structural stability thereof.

Figure 5A:
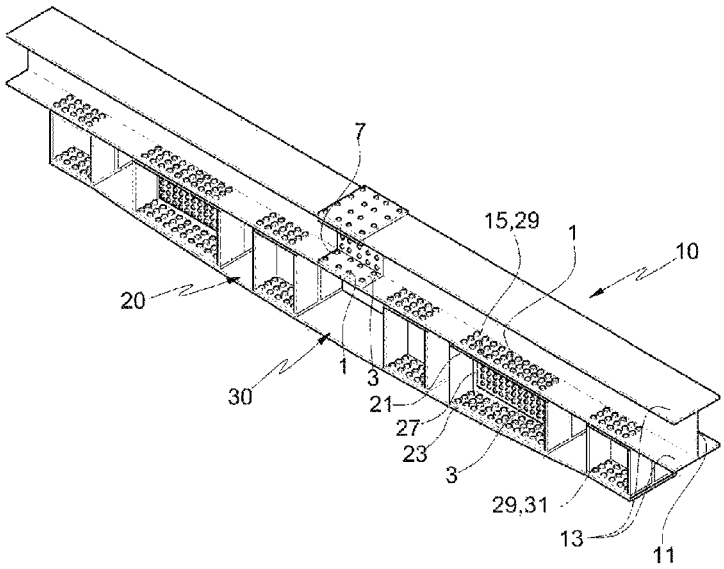
FIGS. 5*a* and 5*b* are perspective and front views showing another variation of the steel structure including pre-stressing brackets according to the present invention.
Figure 5B:
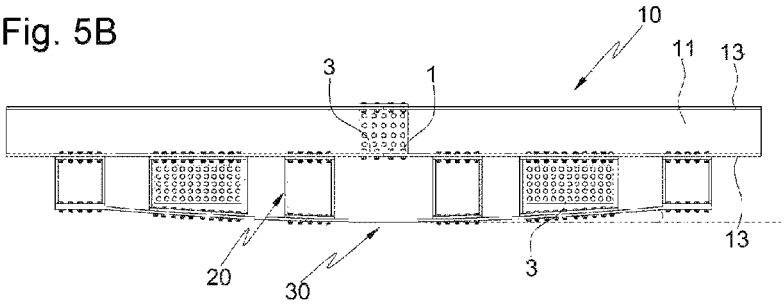

Furthermore, as shown in FIGS. 5*a* and 5*b*, in case where the connecting brackets 20 do not have side plate 25, the portions where the side plate 25 is not provided face each other, that is, the connected portions formed by connecting the upper plates 21, the reinforcement plates 27 and the lower plates 23 are coupled to the steel plate 3.

That is, the plurality of fastening holes 29 is formed on the reinforcement plate 27 of each connecting bracket 20, and the fastening holes are formed on the steel plate 3 correspondingly to the plurality of fastening holes 29, so that the high tension bolts 1 are inserted into the fastening holes 29 of the reinforcement plate 27 and the steel plate 3 and are then fastened with nuts, thereby coupling the neighboring connecting brackets 20.

On the other hand, as shown in FIGS. 2*a* and 2*b* and FIGS. 4*a* to 5*b*, the connecting brackets 20 of the present invention have different heights from each other to allow the cover plate 30 connected to the bottom surfaces thereof to form a downward slope toward the center portion thereof, thereby effectively obtaining the prestressing effects.

Accordingly, the heights of the connecting brackets 20 are gradually increased from both end portions of the cover plate 30 toward the center portion thereof.

In this case, the cover plate 30 has a given slope formed from both end portions thereof toward the center portion thereof.

Therefore, the center portion side plate 25 of each connecting bracket 20 has a longer length than the other side plate 25.

The lower plates 23 connected to the bottom of side plates 25 of the connecting brackets 20 having different lengths have the same inclinations as the slope of the cover plate 30, so that the cover plate 30 connected to the underside of the connecting brackets 20 having given slopes at their corresponding positions has a downward slope toward the center portion thereof.

This is operated as the prestress against the compression force caused by dead load or live load, thereby increasing the uplifting force of the steel structure and obtaining the prestressing effects in a more effective manner.

Since the steel girder 10 and the cover plate 30 are being connected directly to each other, that is, the connecting brackets 20 of the present invention are capable of continuously providing the prestressing effects, without having any structural limit.

Further, the steel girder 10 and the cover plate 30 are spaced apart from each other to increase the stiffness of cross section through the moment of inertia of the expanded section and thus to improve the load-bearing capacity of the steel structure.

Also, the uplifting force of the steel structure is enhanced to provide the prestressing effects in a more effective manner.

According to a method for making the connecting bracket 20, first, the H-beam or I-beam is cut to a given size, and the flanges of the H-beam or I-beam form the upper plate 21 and the lower plate 23, and the web thereof forms the reinforcement plate 27.

Then, the side plates 25 are welded to both sides of the upper plate 21 and the lower plate 23.

Even though not shown in the drawings, moreover, the connecting bracket 20 may be made by just cutting the H-beam or I-beam to a given size, without having the side plates 25 connected to the upper plate 21 and the lower plate 23.

Figure 6A:
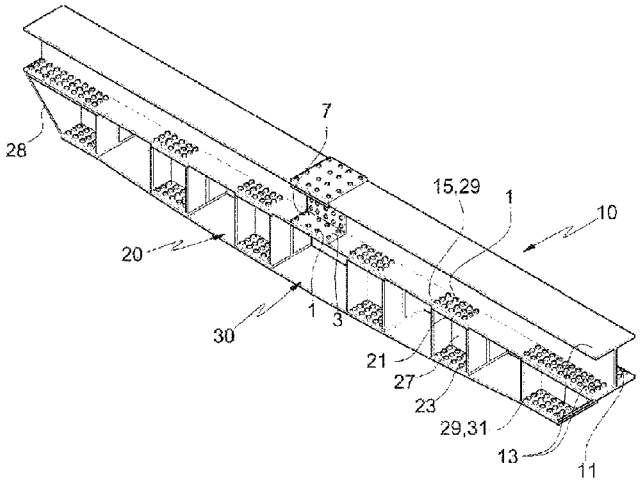
FIGS. 6*a* and 6*b* are perspective and front views showing still another variation of the steel structure including pre-stressing brackets according to the present invention.
Figure 6B:
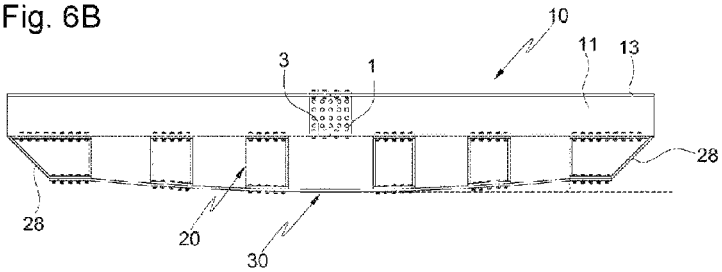

As shown in FIGS. 6*a* and 6*b*, furthermore, the connecting brackets 20 of the present invention are provided in the longitudinal direction of the steel girder 10, and in this case, the connecting brackets 20 positioned at both sides to support both end portions of the cover plate 30 have inclined portions 28 formed on the outside surfaces thereof in such a manner as to have given inclination from an external direction toward the internal direction thereof.

That is, the inclined portion 28 of the connecting bracket 20 has the upper plate 21 longer than the lower plate 23.

The side plate 25 positioned at the inside surface thereof is vertically connected, and the side plate 25 positioned at the outside surface thereof and forming the inclined portion 28 is slantly welded to the upper plate 21 and the lower plate 23 in such a manner as to have the given inclination.

In case where the sections of the connecting brackets 20 positioned at both side portions of the steel structure are drastically varied, stress is locally collected to the drastically varied portions to cause the material to be destructed and cracked, which results in the reduction of the durability of the connecting brackets 20.

Accordingly, the inclined portions 28 are formed on the connecting brackets 20 positioned at both side portions of the steel structure to minimize the variation of the sections thereof, thereby preventing the stress collecting phenomenon from occurring and thus ensuring the excellent durability of the connecting brackets 20.

In the steel structure having the pre-stressing brackets for improving load-bearing capacity and use performance thereof according to the present invention, as shown in FIGS. 1*a* to 5*b*, the cover plate 30 is connected to the underside surfaces of the connecting brackets 20 and applies prestressing against the stress caused by the dead load or live load to the steel structure.

The cover plate 30 of the present invention is made of a steel material and is connected to the lower plates 23 of the connecting brackets 20.

The cover plate 30 has the plurality of fastening holes 31 formed on the corresponding positions thereof to the fastening holes 29 of the lower plates 23. Thus, the high tension bolts 1 are inserted into the fastening holes 29 of the lower plates 23 and the fastening holes 31 of the cover plate 30 and then fastened with the nuts, thereby fixedly coupling the cover plate 30 to the connecting brackets 20.

That is, the cover plate 30 is heated to a given temperature before mounted onto the connecting brackets 20, and the heated cover plate 30 is fixed to the connecting brackets 20. Then, the cover plate 30 is cooled and contracted at a room temperature to previously apply the compression stress to the steel girder 10.

The cover plate 30 from which prestressing is applied resists the tension stress applied to the steel girder 10 through the load of the steel structure itself, that is, dead load or live load, and the stiffness of section thereof is increased by the heights of the connecting brackets 20.

Further, the prestressing applied from the cover plate 30 is introduced continuously, without any stop at the connection portions of the steel girders 10, thereby more improving the load-bearing capacity and use performance of the steel structure.

Furthermore, as shown in FIGS. 3*a* to 4*b*, the steel structure of the present invention further includes a plurality of reinforcement members 40 connected to the portions of the steel girder 10 where the connecting brackets 20 are located.

The reinforcement members 40 are located just on the side plates 25 of the connecting brackets 20 in parallel relation to the side plates 25 in such a manner as to be welded integrally with the steel girder 10.

That is, the reinforcement members 40 serve to reinforce the stiffness of the portions of the steel girder 10 to which the connecting brackets 20 are located, and thus resist the stress applied to the connecting brackets 20 connected to the cover plate 30 at the time of introducing the prestressing through the cover plate 30, thereby increasing the stiffness at the portions where the connecting brackets are located At the time when the prestressing is introduced by means of the cover plate 30, the reinforcement members 40 resist the stress applied to the connecting brackets 20 to which the cover plate 30 is connected, so that the stiffness at the portions where the connecting brackets 20 are located can be increased to provide the structural stability in more efficient manner.

Hereinafter, an explanation on the steel beams modeled using a general purpose structure analysis program (LUCAS 14.0) will be given so as to analyze the effects of a thermal prestressing method to which the connecting brackets according to the present invention are introduced.

In this case, the steel girder, the cover plate and the connecting brackets make use of cell elements, and the models have general steel dimensions.

Figure 7:
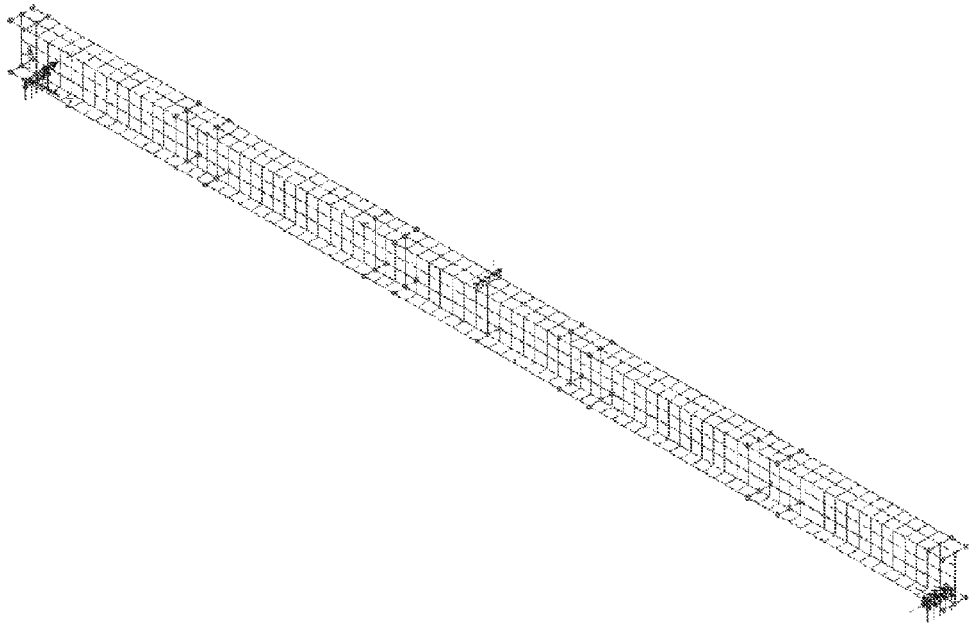
FIGS. 7 to 9 are cell distribution diagrams showing the model types adopted to the experiments of the present invention.
Figure 8:
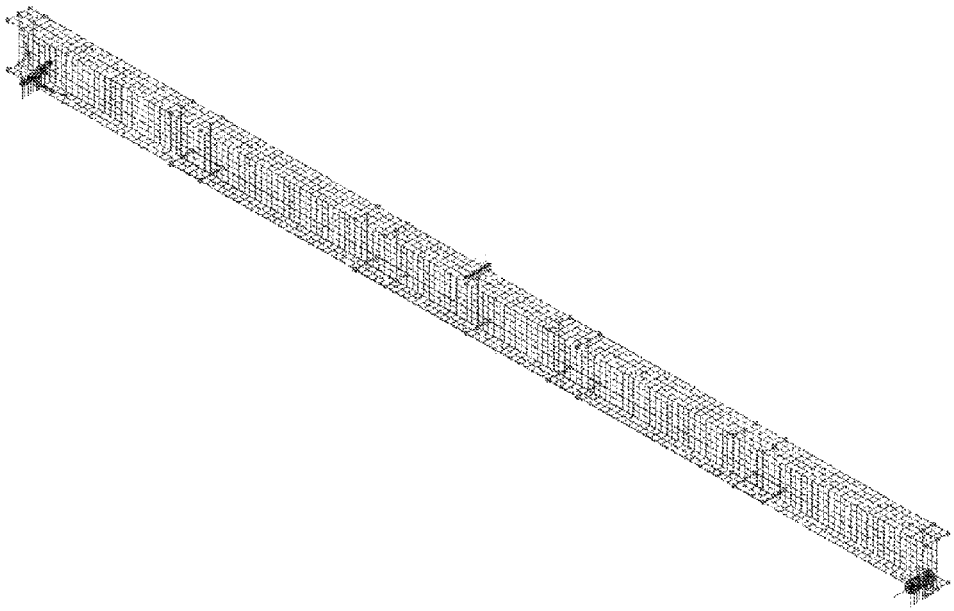
Figure 9:
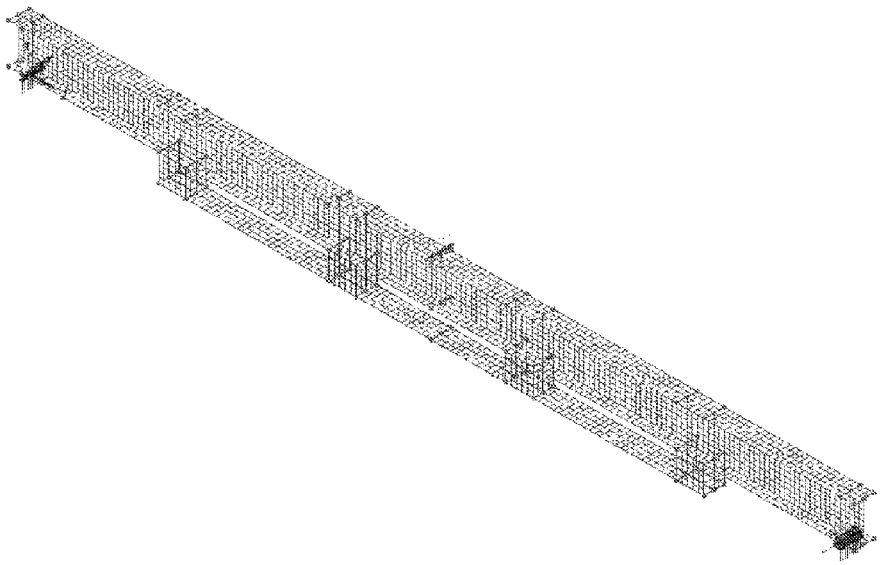
Figure 10:
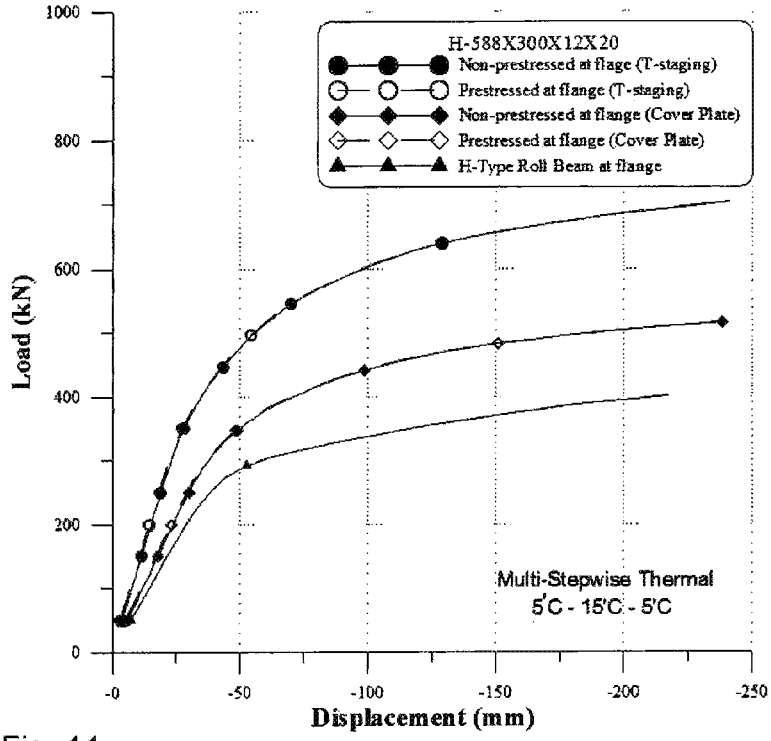
FIGS. 10 and 11 are graphs showing the load-displacement curves as the analyzed values of the model types in FIGS. 7 to 9.
Figure 11:
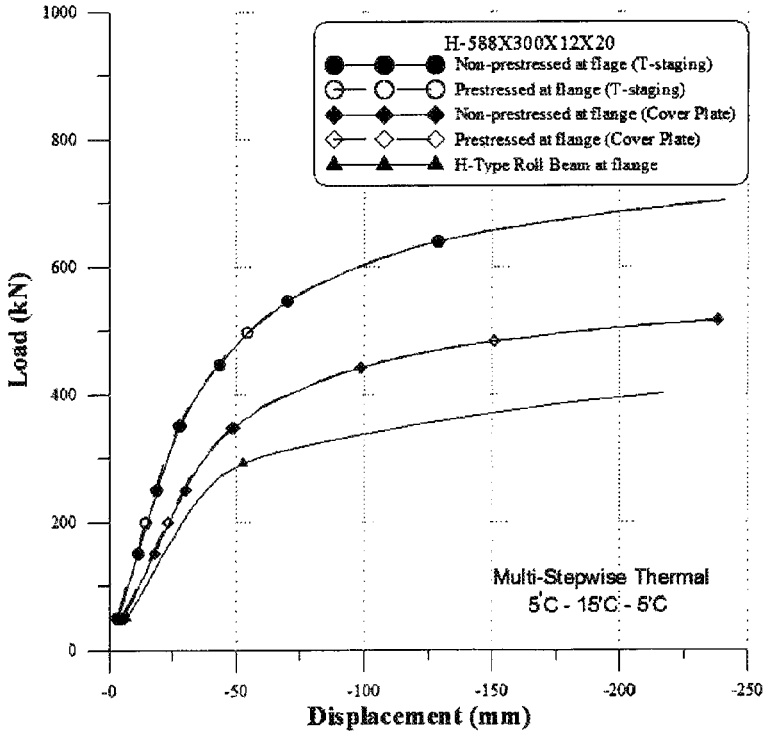

As shown in FIGS. 7 to 9, three types of comparison models are determined, and the analysis values are compared with each other through the load-displacement curves as shown in FIGS. 10 and 11.

Comparison Models

Type 1: general H-beam (see FIG. 7)

Type 2: existing thermal prestressing method (see FIG. 8)

Type 3: thermal restressing method using the connecting brackets 20 of the present invention (see FIG. 9)

The girders of the comparison models had a dimension of H-588×300×12×20, and the types 2 and 3 had the cover plate having the same thickness (12 mm) as each other and introduced multi-stage thermal prestressing (5° C.-15° C.-5° C.).

It was checked that the thermal prestressing method using the connecting brackets of the present invention had the highest stiffness of the elastic region of the beam and the highest yield load in the three types of comparison models.

This was because the cover plate to which the connecting brackets are connected lowered a neutral axis to increase the efficiency of the section.

In the yield load (about 280 KN), the type 1 of general H-beam had the deflection of 45 mm, the type 2 the deflection of 38 mm, and the type 3 the deflection of 21 mm, so that the thermal prestressing method using the connecting brackets of the present invention increased the yield load and decreased the deflection. Accordingly, if the thermal prestressing method using the connecting brackets of the present invention is applied to a temporary structure having a limitation in the allowable deflection, it increases the load-bearing capacity and decreases the deflection to expect more economical design.

Next, an explanation on the structure analysis result obtained using a general purpose finite element analysis program (MIDAS CIVIL) will be given so as to check the thermal prestressing effects in accordance with the heights of the connecting brackets.

Figure 12:
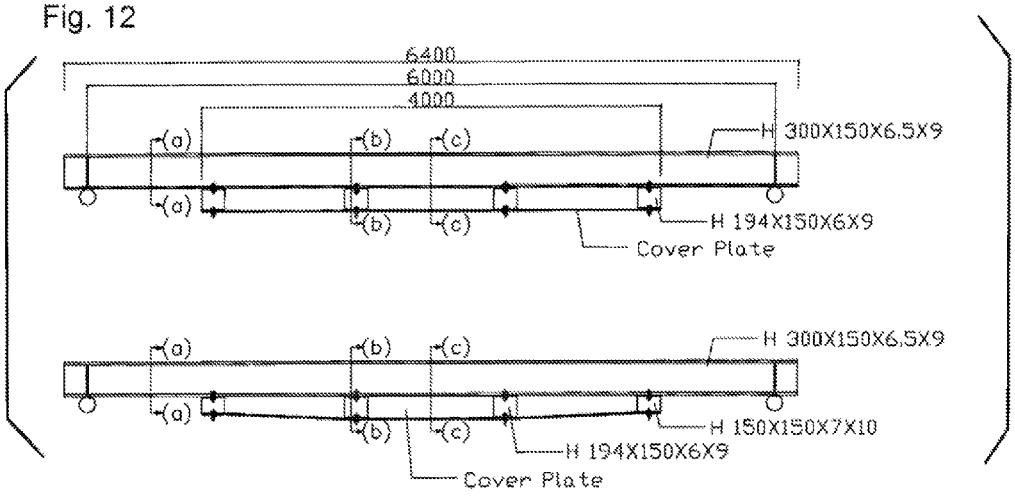
FIGS. 12 to 16 show the results caused when the connecting brackets have the same heights as each other and different heights from each other.

First, the steel girder and the cover plate made use of frame elements, and as shown in FIG. 12, models had the following dimensions.

The girders were the rolled beam having a dimension of H-300×150×6.5×9 of SS400 steel, and the connecting brackets were the rolled beam having dimensions of H-194×150×6×9 and H-150×150×7×10.

A first model had the connecting brackets having the same dimensions (H-194×150×6×9), and a second model had the connecting brackets located at the supports side having the lower heights (H-150×150×7×10) than the other connecting brackets.

Since the tension stress was applied to the cover plate from which the thermal prestressing is introduced, the cover plate was SM520 steel having a thickness of 22 mm and a higher nominal allowable stress than the steel of the girder.

In the structural analysis, support points were considered as fixed ends, and the concentrated load of 50 tonf was applied to the center of the span.

Figure 13:
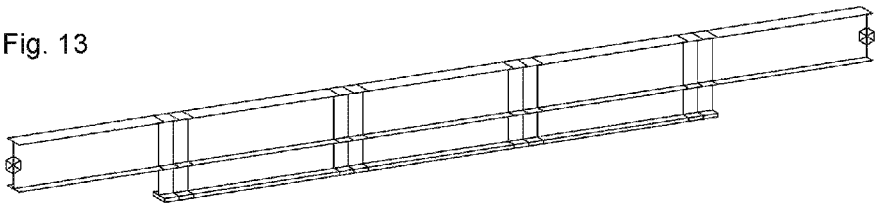
Figure 14:
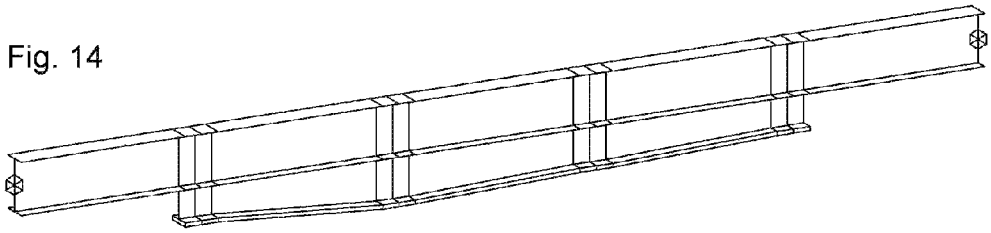

FIGS. 13 and 14 show the models of the structure analysis of the present invention, wherein the connecting brackets have the same heights as each other in FIG. 13 and they have the different heights from each other in FIG. 14.

Analysis Results

So as to test the use performance of the steel structure in accordance with the heights of the connecting brackets, a temperature of 80° C. was applied to the cover plate for the introduction of the prestressing, and after that, the degrees of deflection of the steel girders were checked using the connecting brackets having the same heights as each other and having the different heights from each other.

Figure 15:
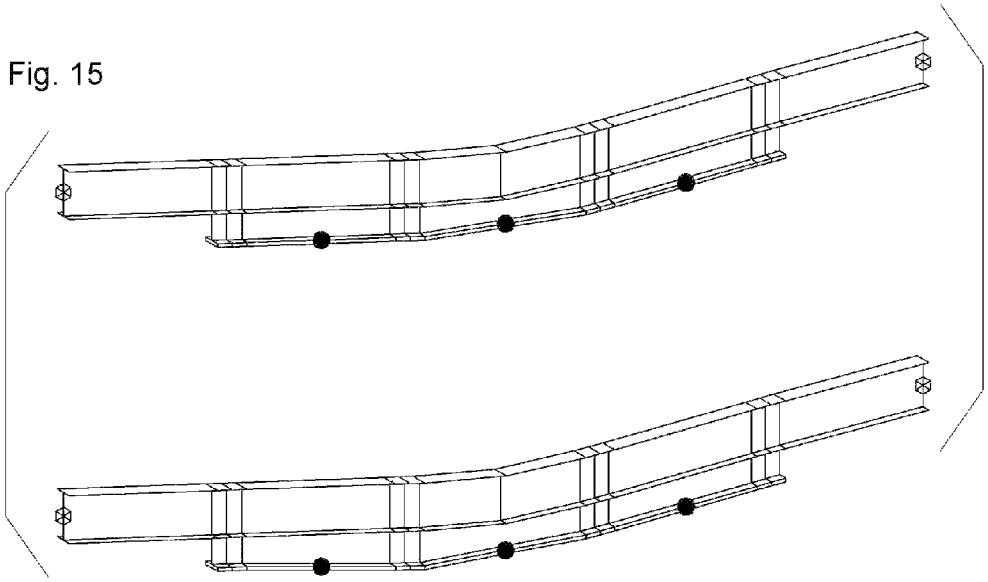

FIG. 15 shows the analysis results obtained in accordance with the heights of the connecting brackets, wherein in case of the steel girder having the connecting brackets having the same heights as each other, a degree of deflection was 15.003 mm, and in case of the steel girder having the connecting brackets having different heights from each other, a degree of deflection was 14.576 mm, such that it was checked that the degree of deflection was reduced by 0.427 mm.

As the connecting brackets have different heights from each other, advantageously, the prestressing causes uplifting force as well as axial force.

Further, a temperature of 80° C. was applied to the cover plate of the steel girder using the connecting brackets having the same heights as each other, and a temperature of 72° C. was applied to the cover plate of the steel girder using the connecting brackets having the different heights from each other, so that the degrees of deflection therebetween were compared with each other.

Figure 16:
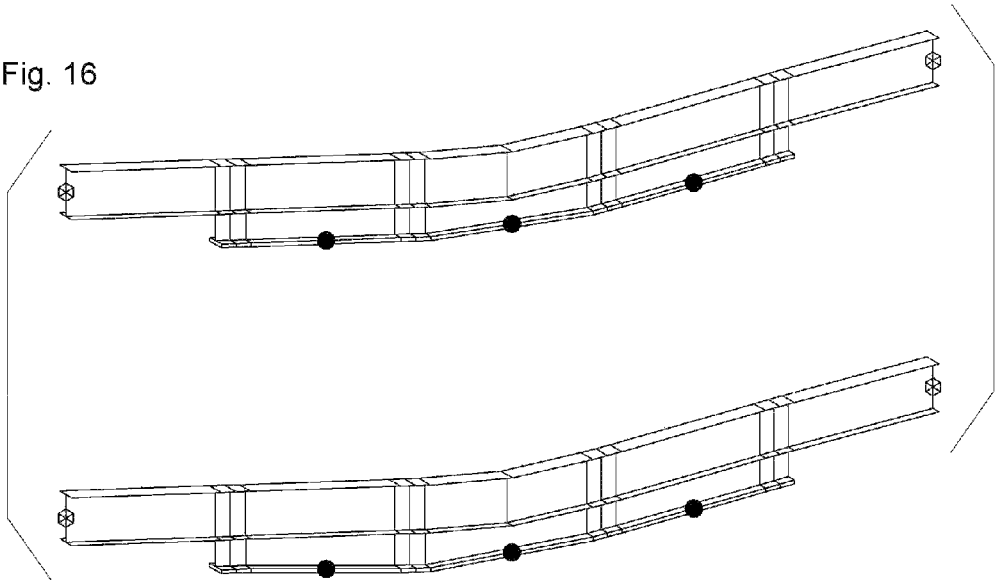

FIG. 16 shows the analysis results obtained in accordance with the differences of the temperatures introduced to the cover plate, wherein in case of the steel girder having the connecting brackets having the same heights as each other, a degree of deflection was 15.003 mm, and in case of the steel girder having the connecting brackets having different heights from each other, a degree of deflection was 14.996 mm, such that even though the difference of the temperatures is just 8° C., the degrees of deflection therebetween are similar to each other, and therefore, if the same effects are generated, the time for the temperature introduction and the period of construction are all saved and the additional expense for the temperature introduction is removed.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

According to the present invention, there is provided the prestressed steel structure for improving the load-bearing capacity and use performance thereof wherein the connecting brackets are spaced apart from each other between the steel girder and the cover plate to prevent the installation of the cover plate from being restricted by the connection portion between the neighboring steel girders, thereby allowing prestressing ranges to be continuously introduced to increase the prestressing effects.

Further, the steel girder and the cover plate are spaced apart from each other by means of the formation of the connecting brackets, thereby increasing moment of inertia of section and optimizing the efficiency of section to provide a bridge for long span.

Furthermore, the connecting brackets are gradually increased in heights from both end portions of the cover plate toward the center portion thereof, thereby strengthening the stiffness of the section at the center portion of the cover plate to optimize the prestressing effects, thus offsetting the stress generated by the dead load (fixed load) of the steel structure, and further increasing the section of the structure by the cover plate to provide economical effects.

The invention claimed is:

1. A steel structure including pre-stressing brackets for improving load-carrying capacity and serviceability, comprising:

a steel girder;

a plurality of connecting brackets connected to the bottom surface of the steel girder and spaced apart from one another; and a cover plate connected to the bottom surfaces of the connecting brackets, wherein the heights of the connecting brackets are gradually increased from both end portions of the cover plate to the center portion thereof.

2. The steel structure including pre-stressing brackets according to claim 1, wherein each connecting bracket comprises:

an upper plate connected to the bottom surface of the steel girder;

a lower plate connected to the cover plate;

side plates connected to both sides of the upper plate and the lower plate; and a reinforcement plate connected to each inner surface of the upper plate, the lower plate and the side plates, parallel to the longitudinal direction of the steel girder.

3. The steel structure including pre-stressing brackets according to claim 1, wherein the steel girder further comprises reinforcement members connected at the corresponding place to the connecting brackets' location.

4. The steel structure including pre-stressing brackets according to claim 2, wherein the steel girder further comprises reinforcement members connected at the corresponding place to the connecting brackets' location.

* * * * *